United States Patent [19]

Crawford

[11] Patent Number: 4,852,774

[45] Date of Patent: Aug. 1, 1989

[54] DISPENSER WITH CLOSURE CAP

[75] Inventor: John C. Crawford, Lake Mahopac, N.Y.

[73] Assignee: Colgate-Palmolive Company, Piscataway, N.J.

[21] Appl. No.: 237,186

[22] Filed: Aug. 26, 1988

[51] Int. Cl.[4] ..... B67D 3/00

[52] U.S. Cl. ..... 222/545; 220/296; 222/391; 222/546; 222/549; 222/551; 222/562

[58] Field of Search ..... 222/391, 386, 546, 549, 222/551, 562, 563, 568, 545; 215/329, 332, 334; 220/288, 293, 296, 304, 328

[56] References Cited

U.S. PATENT DOCUMENTS

| | | | |
|---|---|---|---|
| 1,443,682 | 1/1923 | Gueritey | 220/296 |
| 3,844,443 | 10/1974 | Cudzik | 220/296 |
| 3,885,696 | 5/1975 | Eberhardt | 220/288 X |
| 4,437,591 | 3/1984 | von Schuckmann | 222/391 |
| 4,461,403 | 7/1984 | Prahs | 222/129 |
| 4,479,592 | 10/1984 | Rusing et al. | 222/391 X |
| 4,643,337 | 2/1987 | Heck et al. | 222/391 X |
| 4,673,106 | 6/1987 | Fishman | 222/391 X |
| 4,684,043 | 8/1987 | Foster et al. | 222/386 |

FOREIGN PATENT DOCUMENTS

| | | | |
|---|---|---|---|
| 102690 | 12/1937 | Australia | 220/296 |
| 3007954 | 9/1981 | Fed. Rep. of Germany | 222/386 |
| 271182 | 5/1927 | United Kingdom | 215/332 |

*Primary Examiner*—Kevin P. Shaver

*Attorney, Agent, or Firm*—Richard J. Ancel; Robert C. Sullivan; Murray M. Grill

[57] ABSTRACT

A dispenser for a flowable material comprising, a container having a chamber for retaining the material, and a nozzle defining an outlet orifice for dispensing the material from the container. The dispenser has a cap defining a cavity for covering the nozzle, with the cap being secured to the container at a plurality of rotational positions relative to the container. The cap has a plurality of spaced plugs extending from an inner portion of the cap in the cavity with each of the plugs registering with the nozzle and closing the orifice at different rotational positions of the cap.

8 Claims, 2 Drawing Sheets

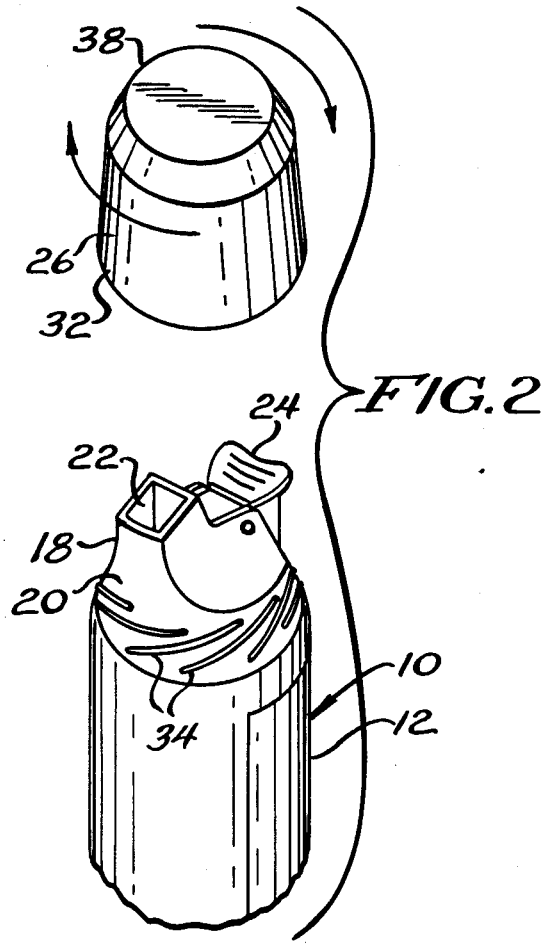
FIG. 2
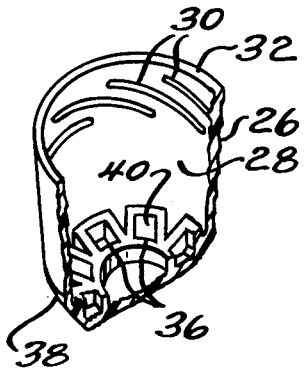
FIG. 1
FIG. 3
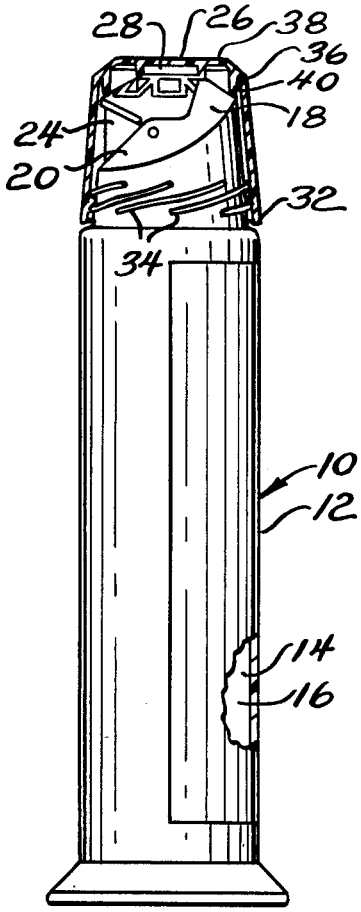
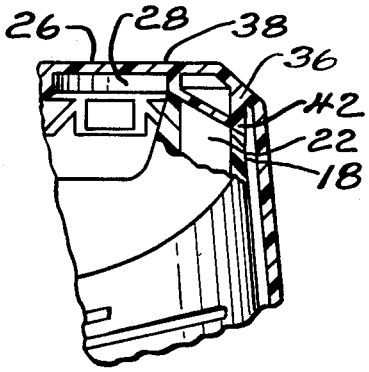
FIG. 4

DISPENSER WITH CLOSURE CAP

BACKGROUND OF THE INVENTION

The present invention relates to a dispenser for a flowable material, such as toothpaste.

Toothpaste has been conventionally sold in squeezable tubes. Recently, dispensers have been introduced for dispensing the toothpaste. Such dispensers have a hollow container for retaining the toothpaste, and a nozzle defining an outlet orifice for dispensing the toothpaste. Separate plugs have been provided to close the orifices prior to use of the dispensers. In the event that the user wishes to reuse the plugs after dispensing some toothpaste, the plugs are reinserted into the nozzles to close the orifices. However, it has been found that when the plugs are removed from the nozzles, they are often misplaced and lost. Also, it is desirable to simplify the attachment procedure for a cap to cover the nozzles. Dispensers are disclosed in U.S. Pat. Nos. 4,461,403 and 4,437,591, incorporated herein by reference.

SUMMARY OF THE INVENTION

A principal feature of the present invention is the provision of an improved dispenser for a flowable material.

The dispenser of the present invention comprises, a container having a chamber for retaining the material, and a nozzle defining an outlet orifice for dispensing the material from the container. The dispenser has a cap defining a cavity for covering the nozzle, with the cap having means cooperating with an upper portion of the container for securing the cap to the container.

A feature of the present invention is that the securing means secures the cap to the container at a plurality of rotational positions relative to the container.

Another feature of the invention is that in a preferred form the closing means requires only $\frac{1}{8}$ to $\frac{1}{4}$ 4 turn of the cap on the container in order to simplify the attachment procedure.

Yet another feature of the invention is the provision of a plurality of spaced plugs on an inner portion of the cap.

Another feature of the invention is that each of the plugs register with or are placed within the nozzle and close the orifice at different of the rotational positions of the cap.

Thus, a feature of the present invention is that the cap may be secured to the container in a simplified manner while closing the nozzle.

Further features will become more fully apparent in the following description of the embodiments of this invention and from the appended claims.

DESCRIPTION OF THE DRAWINGS

In the drawings:

FIG. 1 is a fragmentary perspective view of a cap for a dispenser of the present invention;

FIG. 2 is a fragmentary exploded perspective view of the dispenser of the present invention;

FIG. 3 is a fragmentary elevational view, taken partly in section, of the dispenser;

FIG. 4 is a fragmentary sectional view of another embodiment of the dispenser of the present invention;

DESCRIPTION OF THE PREFERRED EMBODIMENTS

Figure 5:
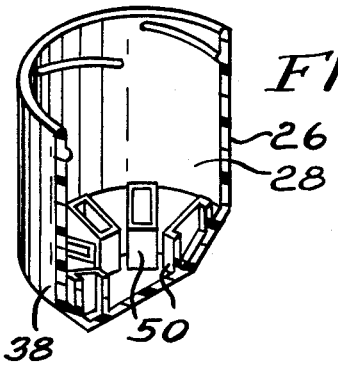
FIG. 5 is a fragmentary perspective view of a cap for another embodiment of a dispenser of the present invention.

Referring now to FIGS. 1–3, there is shown a dispenser generally designated 10 having an elongated container 12 having a chamber 14 to retain a flowable material 16, such as toothpaste. The container 12 has a nozzle 18 adjacent an upper end 20 of the container 12 defining an outlet orifice 22 for dispensing the material 16 from the container 12. The container 12 has a pivoted lever 24 which is actuated in order to pump the material 16 from the chamber 14 through the outlet orifice 22.

The dispenser 10 has a cap 26 defining a cavity 28 for covering the nozzle 18. The cap 26 has a plurality of spaced arcuate inner threads 30 adjacent an outer end 32 of the cap 26. As shown, the threads 30 are disposed peripherally around the outer end 32 of the cap 26 in the cavity 28. The container 12 has a plurality of spaced arcuate grooves 34 adjacent the upper end 20 of the container 12 which are disposed around the container 12, such that the grooves 34 cooperate with the threads 30 on the cap 26 in order to secure the cap 26 onto the container 12 at a plurality of rotational positions of the cap 26 relative to the container 12. In a preferred form, only $\frac{1}{8}$ to $\frac{1}{4}$ 4 turn of the cap 26 is required in order to secure the cap 26 onto the container 12 to close the nozzle 18 in order to simplify the placement procedure of the cap 26 onto the container 12.

The cap 26 has a plurality of spaced plugs 36 extending from an inner portion 38 of the cap 26 around the cap 26 in the cavity 28. In accordance with the present invention, each of the plugs 36 register with the nozzle 18 and close the orifice 22 at different of the rotational positions of the cap 26 relative to the container 12. The plugs 36 may have open outer ends 40 as shown in FIG. 1–3, or closed outer ends 42 as shown in FIG. 4.

Thus, in accordance with the present invention the cap 26 may be secured to the container 12 in a simplified manner utilizing the cooperating threads 30 and grooves 34. Also, when the cap 26 is secured to the container 12, the plugs 36 automatically close the nozzle 18.

Figure 6:
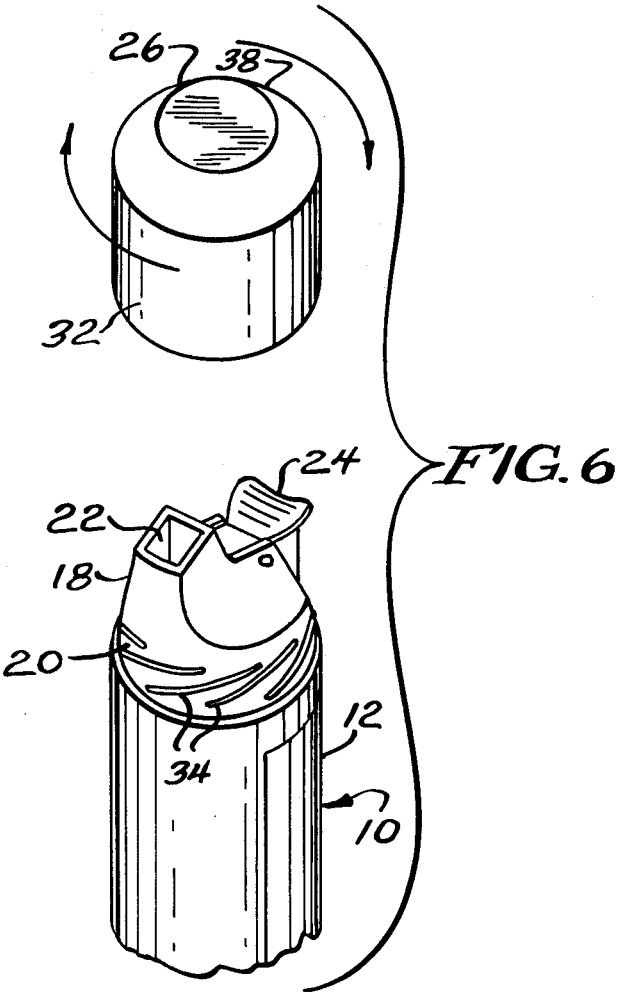
FIG. 6 is a fragmentary exploded perspective view of the dispenser associated with the cap of FIG. 5.
Figure 7:
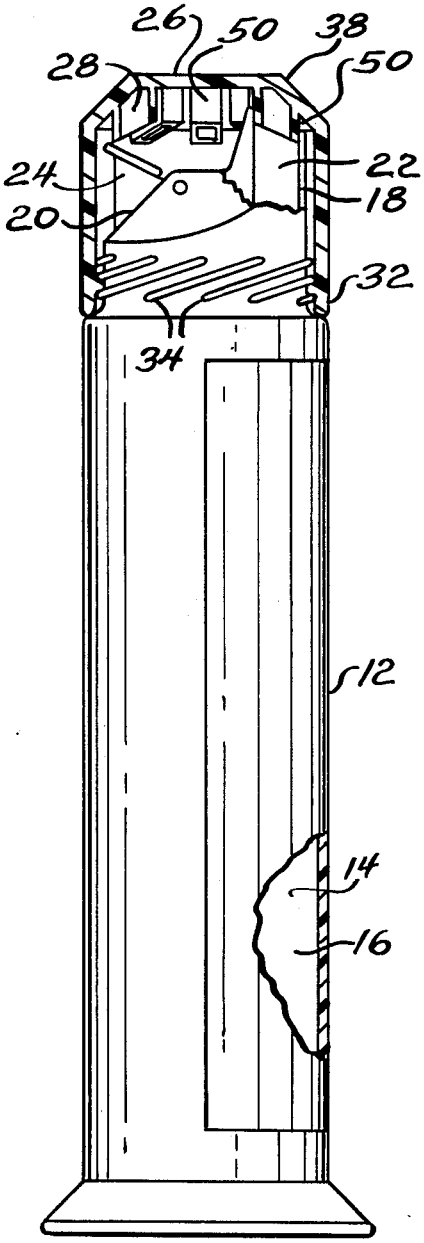
FIG. 7 is a fragmentary elevational view, taken partly in section, of the dispenser of FIG. 6.

Another embodiment of the present invention is illustrated in FIGS. 5–7, in which like reference numerals designate like parts. In this embodiment, the cap 26 has a plurality of spaced plugs 50 extending from the inner portion 38 of the cap 26 around the cap 26 in the cavity 28. The plugs 50 each have outer dimensions slightly smaller than the inner dimensions of the orifice 22. In accordance with the invention, each of the plugs 50 are received in the nozzle 18 and close the orifice 22 at different of the rotational positions of the cap 26 relative to the container 12. The cap 26 and container 12 have arcuate threads 30 and grooves 34, as previously described in connection with FIGS. 1–4.

The foregoing detailed description is given for clearness of understanding only, and no unnecessary limitations should be understood therefrom, as modifications will be obvious to those skilled in the art.

I claim:

1. A dispenser for a flowable material, comprising:

a container having a chamber for retaining the material, and a nozzle being offset from a central axis of the container and defining an outlet orifice for dispensing the material from the container; and a cap for covering the nozzle including means for securing the cap to the container at a plurality of rotational positions relative to the container, and means on the cap for closing the nozzle at each of said rotational positions, wherein the closing means comprises a plurality of inner plugs on the cap which separately register with the nozzle at each of said rotational positions.

2. The dispenser of claim 1 wherein the plugs have open ends facing toward the nozzle.

3. The dispenser of claim 1 wherein the plugs have closed ends facing toward the nozzle.

4. The dispenser of claim 1 wherein the securing means comprises a plurality of separate cooperating arcuate grooves and threads on the cap and container disposed around the cap and container.

5. The dispenser of claim 1 wherein the securing means secures the cap to the container through $\frac{1}{8}$ to $\frac{1}{4}$ turn of the cap.

6. A dispenser for a flowable material, comprising:

a container having a chamber for retaining the material, and a nozzle being offset from a central axis of the container and defining an outlet orifice for dispensing the material from the container; and a cap defining a cavity for covering the nozzle, said cap having means cooperating with an upper portion of the container for securing the cap to the container at a plurality of rotational positions relative to the container, and a plurality of spaced plugs extending from an inner portion of the cap in the cavity, with each of the plugs registering with the nozzle and closing the orifice at different of said rotational positions of the cap.

7. A dispenser for a flowable material, comprising:

a container having a chamber for retaining the material, and a nozzle being offset from a central axis of the container and defining an outlet orifice for dispensing the material from the container; and a cap defining a cavity for covering the nozzle, said cap having means cooperating with an upper portion of the container for securing the cap to the container at a plurality of rotational positions relative to the container, and a plurality of spaced plugs extending from an inner portion of the cap in the cavity, with each of the plugs being received in the nozzle and closing the orifice at different of said rotational positions of the cap.

8. A dispensr for a flowable material, comprising:

a container having a chamber for retaining the material, and a nozzle being offset from a central axis of the container and defining an outlet orifice for dispensing the material from the container; and a cap for covering the nozzle including means for securing the cap to the container at a plurality of rotational postions relative to the container, and means on the cap for closing the nozzle at each of said rotational positions, wherein the closing means comprises a plurality of inner plugs on the cap which are received in the nozzle at each of said rotational positions.

* * * * *